United States Patent [19]

Zilbermann

[11] 3,951,205

[45] Apr. 20, 1976

[54] AIR-CONDITIONING APPARATUS

[75] Inventor: Andre H. Zilbermann, Dallas, Tex.

[73] Assignee: Brandt Engineering Co., Dallas, Tex.

[22] Filed: May 28, 1974

[21] Appl. No.: 473,557

Related U.S. Application Data

[63] Continuation of Ser. No. 281,993, Aug. 18, 1972, abandoned.

[52] U.S. Cl. ..... 165/16; 165/30; 165/22; 98/38 E

[51] Int. Cl.[2] ..... F25B 29/00

[58] Field of Search ..... 165/22, 122, 50, 26, 165/27, 1, 2, 12, 123, 39, 40, 30; 236/13; 98/1.5, 1.5 E

[56] References Cited

UNITED STATES PATENTS

| | | | |
|---|---|---|---|
| 2,231,824 | 2/1941 | Bartlett | 165/123 |
| 2,372,839 | 4/1945 | McGrath | 236/13 |
| 3,179,338 | 4/1965 | Ostrander | 236/13 |
| 3,445,317 | 5/1969 | Marshall et al. | 165/40 |
| 3,517,601 | 6/1970 | Courchesne | 98/38 E |
| 3,583,477 | 6/1969 | Zille et al. | 98/38 E |

*Primary Examiner*—Albert W. Davis, Jr.
*Assistant Examiner*—James D. Liles
*Attorney, Agent, or Firm*—Richards, Harris & Medlock

[57] ABSTRACT

Disclosed is an air-conditioning apparatus for use in controlling the temperature of air in and delivered to a plurality of rooms or spaces. The apparatus has a central utility means which supplies a pressurized volume of cold air. Ducting is provided to connect the cold air supply to a plurality of distribution units, at least one of which is mounted in the vicinity of each room or space. Each distribution unit has a mixing chamber which is in fluid communication with the ducting to allow cool air to flow from the ducting into the mixing chamber. Mounted within the mixing chamber is a blower which causes air to flow from the interior of the mixing chamber through an outlet into the room to be conditioned. Control means are present in the ducting adjacent the distribution unit to sense the presence of pressurized cool air and in turn actuate the unit and blower to cause a flow of air from the mixing chamber. An inlet damper is provided to control the flow of cool air from the ducting into the mixing chamber. A temperature sensing means is located in the room to control the inlet damper and in turn regulate the flow of cool air into the mixing chamber in response to the temperature of air in the room. A second control means is connected to the inlet damper to control the pressure of the air within the mixing chamber. A second inlet is provided to allow air to flow from the room into the mixing chamber. A barometric damper is provided to control the flow of air through the second inlet in response to the pressure of the air within the mixing chamber. A selectively operable heating element is provided in the outlet to heat the air moved by the blower from the mixing chamber into the room. Control means are connected to the temperature sensing means to operate the heating element in response to the temperature of the air within the room.

16 Claims, 4 Drawing Figures

AIR-CONDITIONING APPARATUS

This is a continuation of application Ser. No. 281,993 filed Aug. 18, 1972, now abandoned.

BACKGROUND OF THE INVENTION

The present invention relates generally to improvements in air-conditioning systems wherein a central supply of cool air and at least one distribution unit is provided for each room or volume to be air-conditioned. More particularly, this invention relates to a new and improved air-conditioning system wherein a distribution unit regulates the temperature in a room by selectively controlling the amount of: (1) cool air supplied to the room (2) recirculated air supplied to the room and (3) heating of the air supplied to the room. To accomplish this the present invention utilizes an improved distribution unit which has a blower and heating unit therein which cooperates with a controlled inlet damper and a barometric recirculation damper.

In the air-conditioning and heating of large buildings having a plurality of separate rooms or spaces therein, it has been a general practice to utilize a central air-conditioning system which supplies preconditioned air to each of the rooms or spaces. It has also become a common practice to utilize building construction methods which incorporate a larger amount of glass or other materials on the exterior which have poor thermal insulation properties. Due to the use of these materials with poor thermal insulation properties, the air-conditioning requirements of the different rooms or spaces in the building can vary substantially due to the incidence of sun, wind or other temperature variation sources on one or more of the sides of the building. In addition, for purposes of economy it has been common to deactivate the central air-conditioning system during the night or at times when the building is not in use, thus necessitating that the building during much of the year be heated in the morning prior to the building's use.

Although prior air-conditioning systems which utilize a central unit have served their purpose, they have not proved entirely satisfactory under all conditions of service for the reason that considerable difficulty has been experienced in independently controlling the temperature in various rooms or spaces of the building with different heating and cooling requirements. In addition, during the warm-up in the mornings, it is necessary to operate the complete system, thus adding to the costs of operating the system.

SUMMARY OF THE INVENTION

The general purpose of the present invention is to provide an air-conditioning system for a large building having a plurality of rooms or spaces which embraces all the advantages of a system utilizing a central air source yet eliminates the disadvantage of being unable to simply and efficiently regulate the temperature in the various rooms and to warm the building without operating the entire system. In addition, the heating efficiency of the system is improved by heating recirculated rather than pre-cooled air. To attain this, the present invention contemplates the use of an improved distribution unit which is attached to the central air source in the vicinity of each room to control the amount of air supplied to each room and the temperature of the air within each room. In addition, the system eliminates the necessity of operating the central air source during building warm-up.

OBJECTS OF THE INVENTION

An object of the present invention is the provision of an improved air-conditioning system which utilizes air distribution control units in the vicinity of each space in which the temperature is to be regulated.

Another object of the present invention is the provision of an improved air-conditioning system which controls the volume of air supplied to each space in which the temperature is to be regulated.

A further object of the present invention is the provision of an improved air-conditioning system which regulates the mixture of recirculated and fresh air supplied to each space in which the temperature is to be regulated.

Still another object of the present invention is the provision of an improved air-conditioning system in which warm-up of the building can be accomplished through a distribution unit placed in the vicinity of the space in which the temperature is to be regulated.

Yet another object of the present invention is the provision of an improved air-conditioning system which is simple and inexpensive to manufacture, install and operate.

Other objects and many of the attendant advantages of this invention will be readily appreciated by those of ordinary skill in the art as the same becomes better understood by reference to the following detailed description when considered in connection with the accompanying drawings in which:

DESCRIPTION OF THE PREFERRED EMBODIMENT

Figure 1:
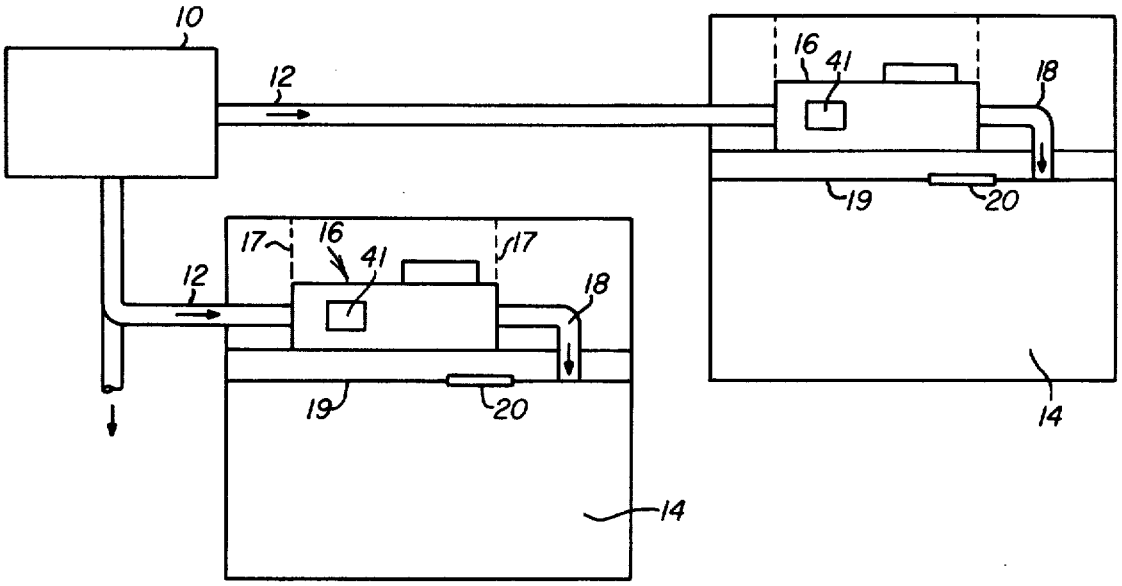
FIG. 1 illustrates a schematic view of the improved air-conditioning system of the present invention showing distribution units in the vicinity of the spaces or rooms in which the temperature is to be regulated.

Referring now to the drawings wherein like reference characters designate like or corresponding parts throughout the several views, there is shown in FIG. 1 a central utility means which for purposes of description is designated by reference numeral 10. This central utility means can be located in a remote portion of a large building and can be one of many commercially available power units which generate a volume of cold air to be transported to the individual rooms through an appropriate ducting system. The central utility means can be powered by any suitable power source available in the building; it is only important that the utility means supply a sufficient amount of cold air as required by the rooms.

Connected to the central utility means is a ducting system 12 which is positioned through the building to transport air from the cold air supply to the vicinity of each of the individual rooms. In addition, the central utility means is provided with a pump (not shown) which causes the cold air to flow into and through the ducting system 12 to the vicinity of each of the rooms.

For purposes of description, only two of the rooms 14 have been illustrated in FIG. 1, it being understood of course that the system has application to buildings having more than two rooms therein. Positioned adjacent each of the rooms 14 is a distribution unit 16. Each distribution unit 16 is supported from the floor above by cables 17 and connected to the ducting 12 to receive the cold air from the central utility means 10. In addition, each distribution unit 16 is provided with additional ducting 18 from transporting air from the distribution unit 16 through the ceiling 19 to the room 14 with which it is associated. A recirculation vent 20 is provided in each of the rooms for allowing air to pass from the room to the space above the ceiling 19 and to the distribution unit 16 as is desired. As will be hereinafter described in detail, each distribution unit 16 is further supplied with control means, a barometric damper, a heating unit and appropriate fan for controlling the temperature of the air in the associated room by controlling the mixture of cool air and recirculated air distributed to the room and the operation of the air heater mounted within the distribution unit 16 itself.

Figure 2:
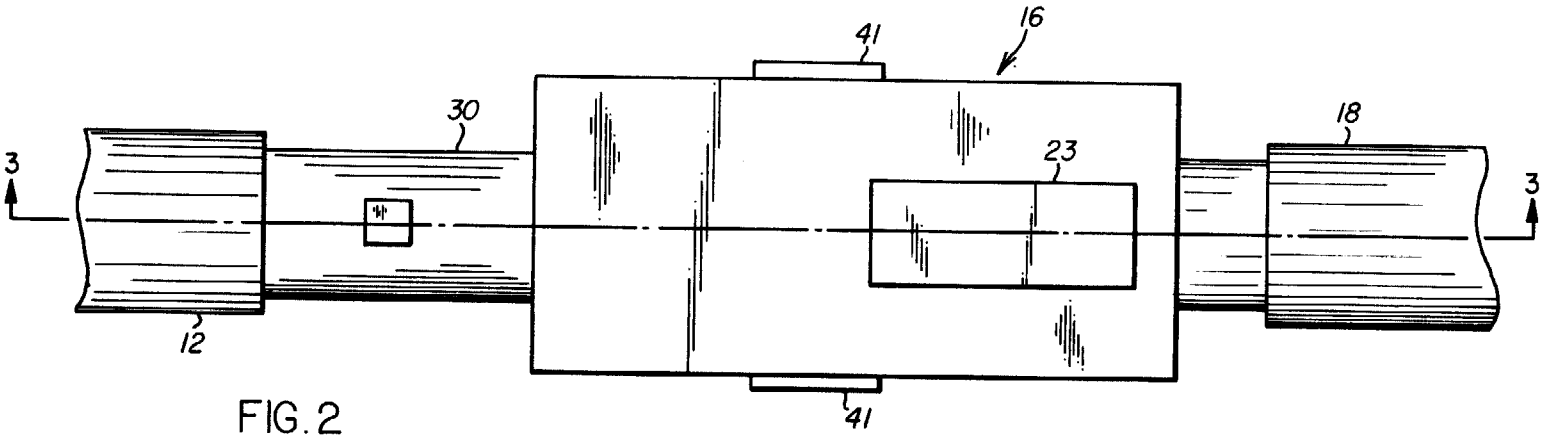
FIG. 2 illustrates a side elevation of the distribution unit shown in FIG. 1.
Figure 3:
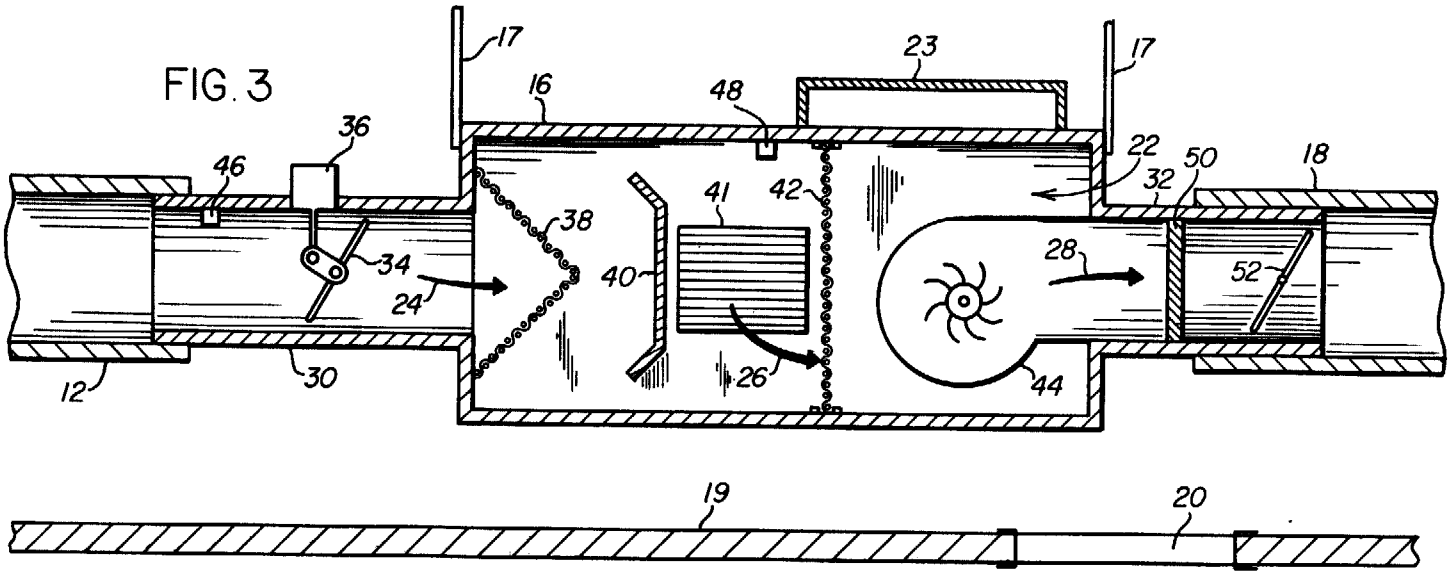
FIG. 3 illustrates a section of the device taken on line 3—3 of FIG. 2, looking in the direction of the arrows showing the internal parts of the distribution unit.

Referring to FIGS. 2 and 3, it can be seen that the distribution unit 16 has a mixing chamber or volume 22 therein. In the present embodiment, the distribution unit 16 is formed from sheet metal material but it is to be understood, of course, that other types of construction methods and materials could be utilized. The unit 16 is also provided with an access door not shown for providing access to the chamber 22 for the purpose of servicing the elements contained therein. In addition, a control housing 23 is attached to the unit 16 to provide a protective cover for appropriate control elements, which will be hereinafter described.

The distribution unit 16 is constructed so that it is airtight and is provided with a first inlet 24, second inlets 26 and an outlet 28 which provide paths for the flow of air into and out of the mixing chamber 22. A duct 30 is attached to and extends from one side of the distribution unit 16 to allow the ducting system 12 to be connected to the first inlet 24. A duct 32 is attached to and extends from the distribution unit 16 to connect the ducting 18 to the outlet 28.

An inlet damper 34 is mounted in the duct 30 to selectively control the air flowing through this duct into the mixing chamber 22. An actuator 36 is mounted on the exterior of the duct 30 and is mechanically connected to the damper 34 to control the movement of the damper. In the present embodiment, this actuator is of the type which is well-known in the art and is operated by an electrical control signal coming from control circuitry which will be hereinafter described. It is envisioned, of course, that the actuator could be of a different type such as those which utilize pressurized gas in their operation.

Mounted within the mixing chamber 22 is a perforated baffle 38 which is positioned to diffuse the flow of air entering the chamber 22 through opening 24. In the present embodiment, this baffle 38 is shown as being constructed from screen material but it is envisioned that other types of construction could be used to diffuse the flow of air entering the chamber 22. Also mounted within the chamber 22 is a fixed solid baffle 40 which is positioned adjacent to the perforated baffle 38 to further deflect the flow of air entering through inlet 24.

As can be seen in FIG. 3, barometric dampers 41 are positioned on either side adjacent to the baffle 40 to allow air to enter the chamber 22 through second inlets 26. These barometric dampers 41 control the flow of air through the second inlets 26. These dampers 41 open when the pressure in the mixing chamber 22 is lower than the pressure in the room and are of the type which are manufactured by Dayton Manufacturing Company and has Model No. 2C517. One type of barometric damper is described in U.S. Pat. 3,517,601. It is envisioned that other types of dampers or control valves which would operate to permit flow of air into the chamber when a low pressure is present within the chamber could be used. As is illustrated, two barometric dampers 41 and two inlets 26 are provided in the distribution unit 16. It is envisioned, of course, that in situations with different air flow rate heating requirements, one or many dampers 41 and inlets 26 could be provided as required.

A conventional filter 42 is positioned within the volume 22 between the outlet 28 and the inlets 24 and 26. This filter 42 is of the type which is normally used in the air-conditioning industry to filter dust and other undesirable particles from the air circulating through the system. The filter 42 can be mounted so that it can be cleaned or replaced through the access door.

A blower 44 is positioned to pump air from the chamber 22 out through the outlet 28 and into the duct 18. In the present embodiment, this blower is shown as being of squirrel-cage type but it is to be understood of course that other types of fans and blowers could be used to create a differential pressure to cause the air to flow from the mixing chamber 22 through the ducting 18 and into the room 14.

Pressure sensor 46 is positioned in the duct 30 on the upstream side of the inlet damper 34, the function and operation of which will be hereinafter described in detail. A second pressure sensor 48 is positioned within the chamber 22, the function and operation of which will likewise be described in detail hereinafter.

A heating element 50 is positioned in duct 32 for use in heating the air flowing through the outlet 28. Located just downstream of the heating element 50 is a damper 52 which can be manually controlled to regulate the flow of air from the mixing chamber 22 through the outlet 28 and into the ducting 18.

Figure 4:
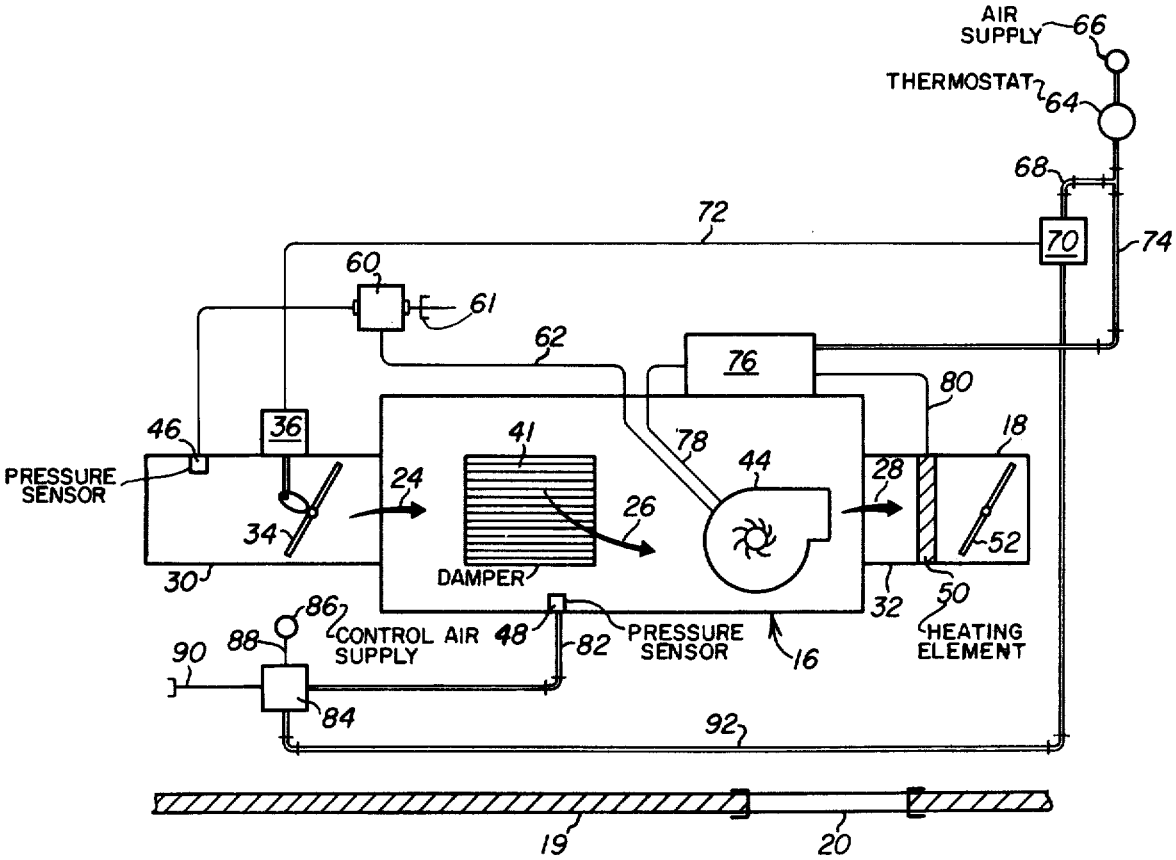
FIG. 4 is a schematic diagram of the distribution unit with a block diagram of the operational elements associated therewith.

In FIG. 4, the distribution unit 16 and its various elements are shown in diagram form with control means shown attached to the various elements. The pressure sensor 46 is shown being attached to a pressure sensitive switch 60 so that when pressure in the ducting 12 reaches a minimum set by an adjustment 61 the pressure sensor 46 will close the pressure sensitive switch 60 which when closed applies power through line 62 to the motor of blower 44 causing the blower 44 to operate and move air through outlet 28. This system causes the blower 44 to operate once the central utility means is supplying pressurized cold air to the distribution unit 16 as sensed by the pressure sensor 46.

A thermostat 64 is positioned in the room 14 to sense the temperature therein. This thermostat 64 is of the type which is connected to a control air supply 66 and in turn regulates the transmission of this pressurized air to operate other elements in the system. The thermostat 64 is connected by line 68 to a pressure sensitive relay 70. This pressure sensitive relay 70 is in turn connected to the actuator 36 by electrical line 72. In operation when the thermostat 64 senses that the temperature in the room 14 is above the desirable maximum, pressure will be transmitted to the pressure sensitive relay 70 through line 68. The relay 70 will in turn operate electrical contacts therein to supply electrical control signals through electrical line 72 to appropriately operate the actuator 36 which in turn controls the position of inlet damper 34. Since pressurized cool air is present in the ducting 12 the thermostat 64, relay 70 and actuator 36 will cooperate to appropriately control the inlet damper 34 to open when the temperature in the room is above a desired maximum and will close the inlet damper 34 when the temperature in the room falls below a desired minimum. In this manner, these elements control the flow of cool air into the mixing chamber 22 of the distribution unit 16.

In addition, the thermostat 64 is connected by line 74 to another pressure sensitive relay 76. This pressure sensitive relay 76 is connected by electrical lines 78 and 80 to the motor of the blower 44 and heating element 50, respectively. In operation, when the thermostat 64 senses the temperature in the room below a desired minimum, pressure will be transmitted through line 74 to actuate pressure sensitive relay 76 which in turn actuates the blower 44 and the heating element 50 to heat the air flowing through outlet 28. when the temperature in the room is sufficiently heated the thermostat 64 will sense the same and will in turn deactuate the blower 44 and the heating element 50.

The pressure sensor 48 is connected through line 82 to a pressure controller 84. The pressure controller 84 is also connected to a control air supply 86 by means of line 88. The pressure controller is provided with an adjustment means 90 for setting the desired pressure at which the pressure controller 84 is actuated. This controller 84 is also connected to the pressure sensitive relay 70 by means of a line 92. In operation, the pressure controller senses the pressure within the interior of the mixing chamber 22 by means of pressure sensor 48 and selectively supplies pressurized air to relay 70 through line 92 when the pressure within the mixing chamber 22 exceeds the desired maximum set by the adjustment means 90. This relay 70 will in turn override pressure signals on line 68 and will cause the actuator 36 to close the inlet damper 34 to in turn reduce the pressure in the chamber 22. In this manner, the pressure sensor 48 and pressure controller 44 operate to prevent pressure within chamber 22 from exceeding a maximum desired operating pressure.

As was previously described, the room 14 has a recirculation air vent 20 which allows air to flow from the room 14 into the volume above the ceiling 19. The unit 16 is provided with barometric dampers 41 which will allow the air from the room to flow into the chamber 22 when the pressure in the chamber is lower than the pressure surrounding the unit 16. When the pressure in the chamber exceeds the pressure surrounding the unit 16, the barometric dampers 41 will close to prevent flow of air into the chamber 22 by way of vent 20.

The manually operated damper 52 located at the outlet 28 of the chamber 22 is utilized to regulate the rate of flow of air from the chamber 22 into the room 14.

The operation of the distribution unit in controlling the temperature in the room is as follows: first, the central utility means is actuated and cold air is supplied to the ducting system 12 whereupon the pressure of the cold air sensed by pressure sensor 46 and blower 44 is in turn actuated to initiate air flow through the distribution unit 16.

The temperature in the room 14 is sensed by thermostat 64 and the inlet damper 34 is modulated according to the temperature in the room to control the supply of cold air entering the mixing chamber 22. As the temperature of the room increases, the inlet damper 34 is modulated to the open position thus supplying a greater volume (up to the limit set by pressure regulator 84) of cold air to the mixing volume and in turn to the room to be cooled. As the temperature in the room decreases, the inlet damper 34 is modulated to the closed position. If the temperature in the room continues to fall, the heating element 50 is actuated to heat the air circulated by the blower 44. In this case the air is circulated from the room 14 through the vent 20, through the barometric dampers 41, into the mixing chamber 22, through the outlet 28, through the ducting 18 and back into the room 14. Thus, it can be seen that air is recirculated through the mixing volume 22 when it is desired to raise the temperature in the room.

Due to the control system, variations of the above can be obtained. For example, when it is desirable to only lower the temperature in a room a small amount, the inlet damper 34 can be modulated to a partially open position whereupon the air being moved by blower 44 through the outlet 28 is a mixture of the cool air entering through inlet 34 and recirculated air entering through inlets 26, as permitted by barometric dampers 41.

In addition, the differential pressure control 84 will protect the system against excessive pressures and prevent the system from operating with a static pressure which is too high within the mixing chamber.

Since different rooms in the building require different heating and cooling rates due to the location of the rooms within the building, the units 16 can be utilized to provide an efficient and independent temperature control for each of the rooms in the building.

The system will also operate to preheat the various rooms within the building without the necessity of operating the central utility 10. This is accomplished by operating the blower 44 to cause air to flow into the chamber 22 through the barometric damper 41 and out of the chamber through outlet 28. In addition, the heating element 50 can be actuated to heat the air as it is recirculated into the room even though the central utility 10 is deactuated.

Obviously, many modifications and variations of the present invention are possible in light of the above teachings. It is therefore to be understood, that within the scope of the appended claims, the invention may be practiced by those of ordinary skill in the art otherwise than as is specifically described herein.

What is claimed is:

1. Apparatus for controlling the temperature of the air in a volume comprising:

a supply of air, chamber means having a first inlet means, second inlet means and an outlet, said supply of air being connected to said first inlet means, first valve means for selectively regulating the flow of supply air into said chamber through said first inlet means, first control means operatively connected to said first valve means for operating said first valve in response to the temperature of the air in the volume and the difference in static pressure between the air in said chamber means and said volume.

first means connecting said outlet to said volume for transporting air from said chamber to said volume, said second inlet means being connected to said volume for transporting air from said volume to said chamber, second valve means for selectively regulating the flow of air through said second inlet means from said volume into said chamber, pump means for causing air to flow from said chamber through said first connecting means to said volume, selectively operable air temperature conditioning means for altering the temperature of air flowing from said chamber through said first connecting means to said volume, and second control means operably connected to said air temperature conditioning means to change the temperature of said air flowing through said first connecting means in response to the temperature of the air in said volume.

2. An apparatus as defined in claim 1 wherein said air temperature conditioning means is positioned in said outlet.

3. An apparatus as defined in claim 1 wherein said first and second valve means are independently operable.

4. An air-conditioning system for a plurality of rooms, comprising in combination:

utility means for supplying a volume of air at a selected temperature, first conduit means for transporting air from said utility means to the vicinity of each room, means at said utility means for causing air to flow from said utility means through said conduit means, and a plurality of distribution means, at least one distribution means connected to said conduit means in the vicinity of each of said rooms, each of said distribution means comprising a housing defining a chamber, first inlet means for transporting air from said first conduit means into said chamber, second inlet means for transporting air from one of said rooms into said chamber, a barometric damper interposed between the second inlet means and the chamber for admitting air from the rooms into the chamber when the pressure in the chamber is less than the pressure of air in the second inlet means, outlet means for transporting air from said chamber into said one of said rooms, a blower which can accept air from said second inlet means and discharge it through the outlet means, temperature altering means for changing the temperature of air flowing through said outlet means, control means operable in response to the temperature in said one of said rooms, said control means being operable in a first range wherein the air transported through said outlet consists of air from said first inlet means, in a second range wherein the air transported through said outlet means consisting of air from said first and second inlet means, in a third range wherein the air transported through said outlet means consists of air from said second inlet, and in a fourth range wherein the air transported through said outlet means consists of air from said second inlet which has been changed in temperature by said temperature altering means.

5. A system as defined in claim 4 wherein said temperature altering means is mounted in said outlet means.

6. A system as defined in claim 4 additionally comprising a pump means in said outlet for causing air to flow from said chamber into said one of said rooms.

7. An air distribution unit adapted to be used in an air-conditioning apparatus which includes a central source of air and is utilized to condition air in a space, which distribution unit comprises:

a housing defining a volume, said volume having first inlet means for receiving air from the central source, second inlet means for receiving air from a space to be conditioned and an outlet in fluid communication with said housing for discharging conditioned air into the space, a blower means for accepting air from said first and second inlet means and discharging it into the outlet in the housing, first valve means selectively regulating the flow of air into said volume through said first inlet means, second valve means selectively regulating the flow of air into said volume through said second inlet means, the second valve means being responsive to the difference in static pressure between the air inside said volume and the air in the space to be conditioned for admitting air to said volume from said space to be conditioned when the pressure of the air in said volume is less than the pressure of the air in the space to be conditioned.

8. An apparatus as defined in claim 7 additionally comprising an air temperature conditioning means for altering the temperature of air flowing from said outlet.

9. An apparatus as defined in claim 8 wherein said air temperature conditioning means is positioned in said outlet.

10. An apparatus as defined in claim 7 wherein said first and second valve means are independently operable.

11. An apparatus as defined in claim 7 additionally comprising means for transporting air from said volume through said outlet.

12. An air-conditioning system for a plurality of rooms, comprising in combination:

utility means for supplying a volume of air at a selected temperature, first conduit means for transporting air from said utility means to the vicinity of each room, pump means at said utility means for causing air to flow from said utility means through said conduit means, and a plurality of distribution means, at least one distribution means connected to said conduit means in the vicinity of each of said rooms, each of said distribution means comprising a housing defining a chamber, first inlet means for transporting air from said first conduit means to said chamber, second inlet means for transporting air from one of said rooms to said chamber, outlet means for transporting air from said chamber to said one of said rooms, a blower for accepting air from said first and second inlet means and discharging it through said outlet means, first valve means selectively regulating the flow of air into said chamber through said first inlet means, second valve means selectively regulating the flow of air into said chamber through said second inlet means, control means connected to said second valve means for controlling said second valve means in response to the difference in static pressure between said chamber and said one of said rooms to admit air to said chamber from one of said rooms when the pressure of the air in the chamber is less than the pressure of the air in the space to be conditioned.

13. A system as defined in claim 12 additionally comprising an additional control means connected to said first valve means for operating said first valve means in response to the temperature in one of said rooms.

14. A system as defined in claim 12 additionally comprising temperature altering means for changing the temperature of air flowing through said outlet means.

15. A system as defined in claim 14 wherein said temperature altering means is mounted in said outlet.

16. A system as defined in claim 12 additionally comprising means for transporting air from said chamber through said outlet.

* * * * *